US006994429B1

(12) United States Patent
McEntee et al.

(10) Patent No.: US 6,994,429 B1
(45) Date of Patent: Feb. 7, 2006

(54) PRINTHEAD FLUID SUPPLY SYSTEM

(75) Inventors: John F. McEntee, Boulder Creek, CA (US); Jay K. Bass, Mountain View, CA (US)

(73) Assignee: Agilent Technologies, Inc., Palo Alto, CA (US)

( * ) Notice: Subject to any disclaimer, the term of this patent is extended or adjusted under 35 U.S.C. 154(b) by 0 days.

(21) Appl. No.: 10/017,107

(22) Filed: Dec. 13, 2001

(51) Int. Cl.
*B41J 2/175* (2006.01)

(52) U.S. Cl. ..... 347/85

(58) Field of Classification Search ..... 347/85–87; 436/518
See application file for complete search history.

(56) References Cited

U.S. PATENT DOCUMENTS 4,772,900 A * 9/1988 Nagoshi ..... 347/7
5,367,328 A * 11/1994 Erickson ..... 347/7
5,658,802 A * 8/1997 Hayes et al. ..... 436/518
5,721,576 A * 2/1998 Barinaga ..... 347/85
6,077,674 A 6/2000 Schleifer et al.
6,083,762 A * 7/2000 Papen et al. ..... 436/180
6,242,266 B1 * 6/2001 Schleifer et al. ..... 436/518
6,325,354 B1 * 12/2001 Hoen et al. ..... 251/65
6,458,583 B1 * 10/2002 Bruhn et al. ..... 435/287.2
6,733,114 B2 * 5/2004 Kobayashi et al. ..... 347/85
2002/0138228 A1 * 9/2002 Faulkner et al. ..... 702/138

* cited by examiner

*Primary Examiner*—Michael Nghiem

(57) ABSTRACT

A printhead fluid supply system for use in ink-jet or pulse-jet type printers is described. A manometer feature may be used as a pressure gauge to maintain desired pressure at a printhead. Additional features that may be used in the invention including a supply tubing setup configured to avoid introduction of air into a printhead. The system may be configured to allow for replenishing printing fluid supply while the system is running. This may be accomplished using a secondary fluid supply, to replenish a primary, pressure-compensated fluid reservoir. The system may be used in any sort of ink-jet or pulsejet printing system, such as those commonly used in document production or in more specialized applications such as microarray production.

14 Claims, 2 Drawing Sheets

PRINTHEAD FLUID SUPPLY SYSTEM

FIELD OF THE INVENTION

This invention relates to the provision of fluid to ink-jet or pulse-jet printheads. It is especially concerned with providing a printhead with continuous supply of medium at appropriate pressure.

BACKGROUND OF THE INVENTION

Two primary "ink-jet" or "pulse-jet" type printers exist. One type, commonly described as a "bubble jet" printer, works by vaporizing propellant in a liquid print medium inside a nozzle with a small resistive heater to create a bubble that displaces the liquid therein through an orifice toward a target. The other type uses piezoelectric elements to displace and drive liquid print medium through a nozzle orifice.

Especially when used to deposit substances other than ink, such printheads are sometimes referred to as "pulse-jet" devices in the alternative. Regardless of their designation, the printheads operate by delivering a pulse of pressure (e.g., by a piezoelectric or thermoelectric element as noted above) to liquid adjacent an outlet or orifice such that a drop will be dispensed therefrom.

Ink-jet/pulse-jet syle printheads have come to be used in a variety of applications. A popular use of such devices is printing ink on paper. Another use is in producing "biochips" or arrays in which fluid compositions of binding agents e.g., bipolymers such as oligonucleotides and peptides, or precursors thereof, e.g., amino acid or nucleotide residues, are deposited onto a solid support surface in the form of an array or pattern.

Pulse-jet devices may be used to produce such arrays or microarrays with other apparatus and methods as described in U.S. patent application Ser. No. 09/150,504 titled, "Method and Apparatus for Making Nucleic Acid Arrays"; U.S. patent application Ser. No. 09/300,589 titled, "Method of Performing Array-Based Hybridization Assays Using Thermal Inkjet Deposition of Sample Fluids"; U.S. patent application Ser. No. 09/846,474 titled "Error Detection In Chemical Array Fabrication"; and U.S. Pat. Nos. 6,242,266 and 6,180,351. Other components or array printing systems which may be adapted for use with the present invention include those used to dispense bio/chemical agents such as proteins and nucleic acids as described in U.S. Pat. Nos. 4,877,745; 5,338,688; 5,474,796; 5,449,754; 5,700,637; and 5,658,802.

Whether used for producing arrays, dispensing fluid samples, in connection with known methodology as in the references noted or otherwise, the present invention addresses a number of well-known problems with ink-jet or pulse-jet printheads. These problems include proper pressure maintainance at the printhead level during print medium reservoir depletion and avoiding air entrapment that disrupts printhead function.

The present invention addresses problems associated with pressure maintenance through optional pressure equilization/maintenance features. In each type of printhead noted above, the nozzles typically have an open orifice. Ideally, cappilary forces hold liquid in the nozzles ready for dispensing. However, too much negative pressure on a fluid supply at the nozzle overcomes the capillary action. This excessive negative pressure causes printhead malfunction through nozzle arration. Further, the stop junction provided at the nozzle end can be breached when overly high fluid supply pressures are applied. Such a breach causes the nozzle to drip.

Providing proper fluid supply pressure can be particularly difficult in connection with large fluid supply reservoirs, where liquid levels can vary greatly with respect to printhead level as print medium is consumed. Sometimes, partial vacuum or air pressure is applied to a reservoir in an effort to balance pressure effects. The present invention offers a highly effective approach, particularly where large fluid reservoirs are concerned.

Also, certain features of the present invention address air entrapment issues presented by ink-jet or pulse-jet systems. Before a printhead is used, it must be fully filled in order to operate reliably. A small bubble trapped at a critical location (such as in the vicinity of a piezoelectric element or bubble generator) can prevent firing. Optional features of the invention avoid the need for air purging upon changing a fluid reservoir. These features also allow for supply change-out during printhead operation.

Those with skill in the art may well appreciate further utility or possible advantages in connection with the invention described herein. Whatever the case, it is contemplated that some variations of the invention will only afford certain advantages, while others will present all of them.

SUMMARY OF THE INVENTION

Features of the invention provide for optimal pressure regulation of a print medium to an ink-jet or pulse-jet printhead. Preferably, a manometer included in the system allows for controlled feedback to a pressure/vacuum source connected to a fluid supply to maintain desired pressure at a printhead irrespective of fluid supply levels. Other optional features of the invention prevent air from entering a printhead and allow re-filling a fluid supply during printing. Use of a secondary supply vessel with appropriate pressure regulation may be used to accomplish in-process refilling.

The present invention includes systems having any of these features and methods of using the same. Furthermore, complete manufacturing systems including printhead(s) and printing material form part of the present invention. Product produced with the systems and methodology described also form part of the invention.

BRIEF DESCRIPTION OF THE DRAWINGS

Each of the following figures provide examples diagrammatically illustrating aspects of the present invention. Of these.

DETAILED DESCRIPTION OF THE INVENTION

Before the present invention is described in detail, it is to be understood that this invention is not limited to the particular variations set forth and may, of course, vary. Various changes may be made to the invention described and equivalents may be substituted without departing from the true spirit and scope of the invention. In addition, many modifications may be made to adapt a particular situation, material, composition of matter, process, process step or steps to the objective, spirit and scope of the present invention. All such modifications are intended to be within the scope of the claims made herein. Furthermore, where a range of values is provided, it is understood that every intervening value, between the upper and lower limit of that range and any other stated or intervening value in that stated range is encompassed within the invention. That the upper and lower limits of these smaller ranges may independently be included in the smaller ranges is also encompassed within the invention, subject to any specifically excluded limit in the stated range. Where the stated range includes one or both of the limits, ranges excluding either both of those included limits are also included in the invention.

Unless defined otherwise, all technical and scientific terms used herein have the same meaning as commonly understood by one of ordinary skill in the art to which this invention belongs. Although any methods and materials similar or equivalent to those described herein can also be used in the practice or testing of the present invention, the preferred methods and materials are now described. All publications, patents and patent applications mentioned herein are incorporated herein in their entirety. The referenced items are provided solely for their disclosure prior to the filing date of the present application. Nothing herein is to be construed as an admission that the present invention is not entitled to antedate such material by virtue of prior invention.

It is also noted that as used herein and in the appended claims, the singular forms "a," "and," and "the" include plural referents unless the context clearly dictates otherwise. Further, the use of exclusive terminology such as "solely," "only" and the like in connection with the recitation of any claim element is contemplated. Also, it is contemplated that any element indicated to be optional herein may be specifically excluded from a given claim by way of a "negative" limitation. Finally, it is contemplated that any optional feature of the inventive variation(s) described herein may be set forth and claimed independently or in combination with any one or more of the features described herein.

Figure 1:
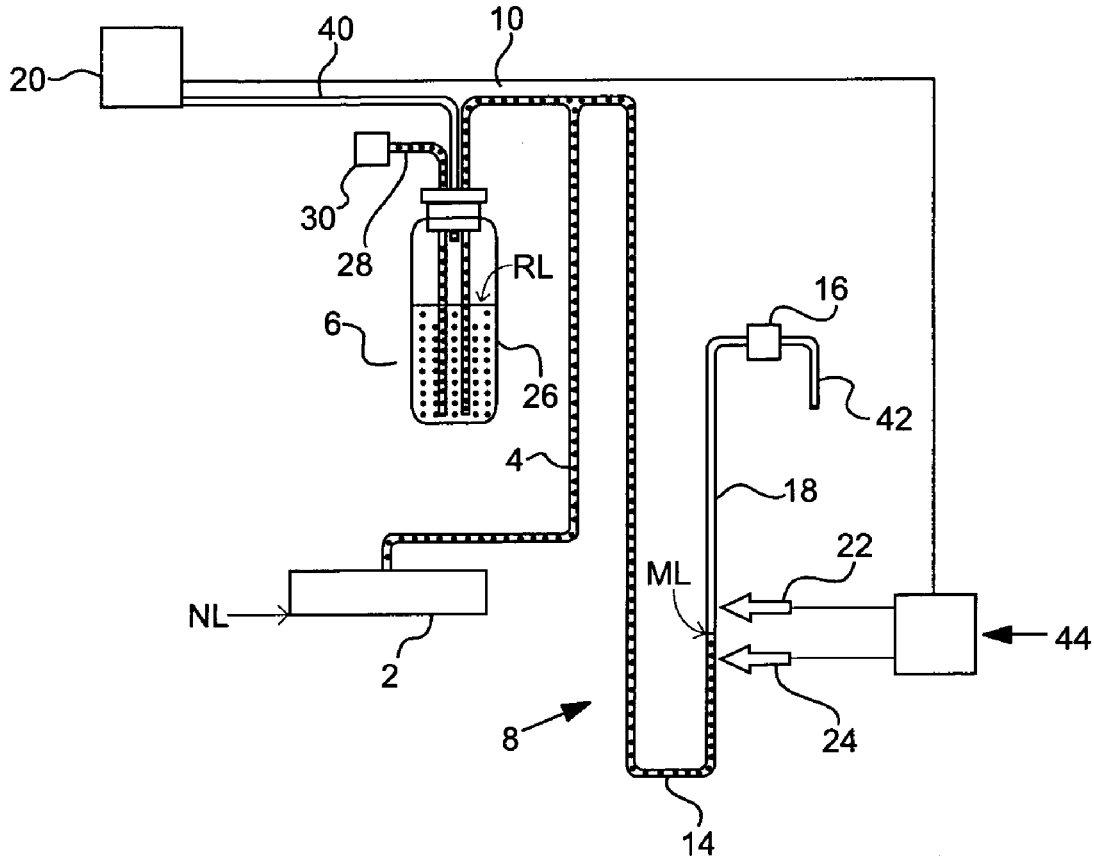
FIG. 1 shows a view of a variation of the inventive system.

Turning now to FIG. 1, elements of the present invention are shown. A printhead (2) is connected by a printhead supply line (4) to a fluid reservoir (6). A manometer (8) is situated in parallel with the supply line. Each of the manometer (8) and printhead supply line (4) are in fluid communication with a fluid supply exit line (10).

The purpose of the parallel arrangement is so manometer (8) provides an indication of pressure applied at the printhead. Saying that the manometer (8) and printhead supply line (4) are connected "in parallel" does not necessarily refer to their physical orientation, but is rather an analogy to an electrical circuit setup. Put another way, it may be said that the manometer and printhead fluid supply line are not connected in series as are other printhead/manometer systems known in the art.

While manometer (8) and supply line (4) are shown as fed by a common fluid supply exit line (10), they may each be individually connected to fluid reservoir (6). In any case, lines may be connected to fluid reservoir (6) by way of a stopper (12) with holes therein for receiving the lines.

Figure 2:
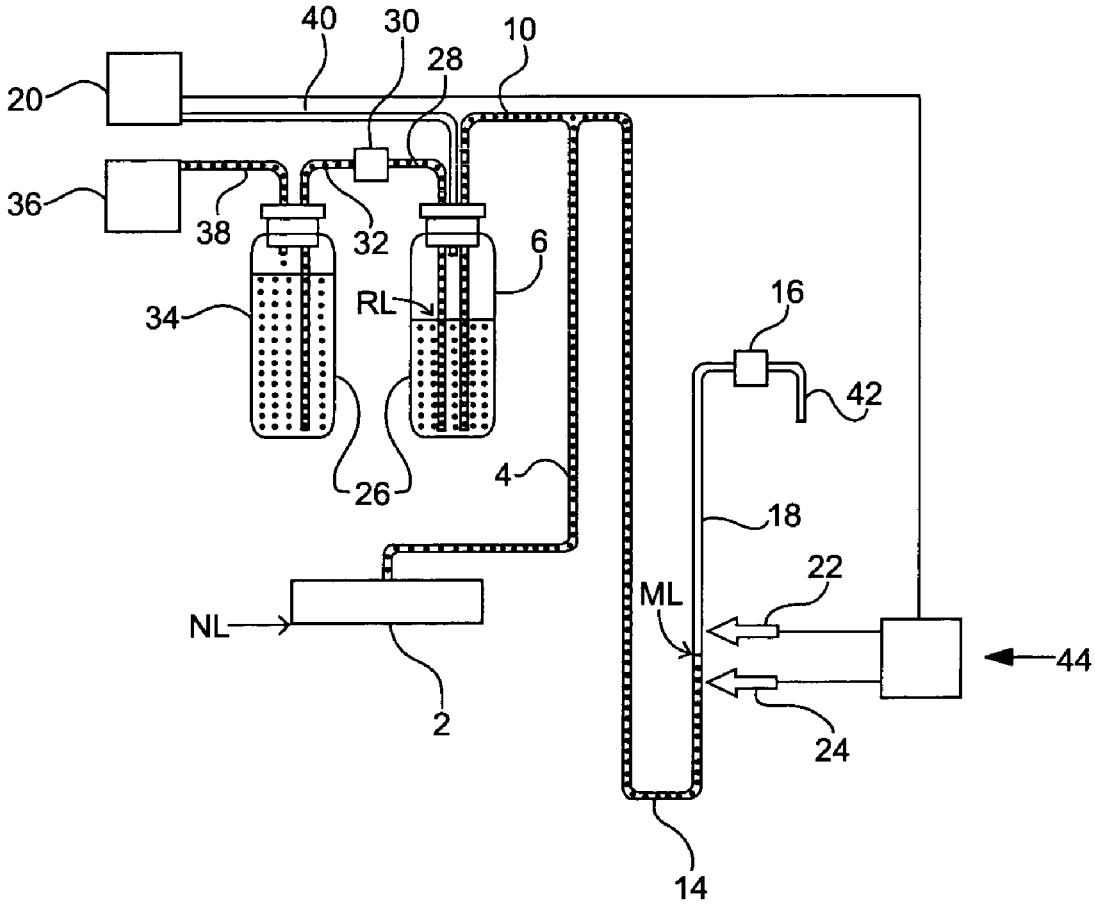
FIG. 2 shows the system in FIG. 1 as it may be refilled.

Depending on the particular device configuration, it may be desirable to apply a positive or negative pressure to the fluid at a printhead nozzle level (NL), e.g., less than 15 psi; less than 10 psi; less than 7 psi; less than 5 psi, etc. A manometer fluid level (ML) may be located substantially as shown in FIGS. 1 and 2. Indeed, in some instances, zero-pressure or full pressure compensation of print medium may be desired.

For a manometer open to the environment to function properly in such circumstances, it will include a turn (14) set below the printhead nozzle level (NL). Should it be desired to configure the manometer to utilize a partial vacuum over fluid therein, the turn may then be located higher up.

Still, it is preferred to use a simple manometer with column (18) open to atmospheric pressure. Optional valve (16) placed inline with manometer (8) will typically be left open during normal operation. In this way, the manometer fluid level (ML) correlates directly to the pressure head at the nozzle level (NL). Valve (16) is preferably closed only when it is desired to pump fluid through supply line (4) to purge printhead (2) when necessary.

However manometer (8) is configured, it may be used to provide feedback allowing adjustment of a pressure/vacuum compensation source (20) in communication with fluid reservoir (6). Preferably, high and low sensors (22) and (24) are set to monitor the fluid level, where signals they provide to a control unit (44) manipulate the output of compensation source (20).

Off-the-shelf componentry may be used for control unit (44) or custom-designed hardware and/or software may be employed. Any type of sensor may be used, though an optical sensor may be preferred. Accordingly, the manometer tube in the area of the sensors may be transparent to facilitate monitoring manometer level (ML). Compensation source (20) may comprise a vacuum generator, such as a venturi, a common pump or a regulated compressed gas source. An inert gas, such as $N_2$ or a noble gas, should be used in the event the compensation source is to apply pressure to maintain manometer fluid level (14).

Feedback provided by high and low sensors (22) and (24), respectively, monitoring monometer level (ML) provide a convenient and highly precise means of accounting for a changing reservoir fluid level (RL) of print medium (26) that would otherwise affect the pressure of print medium at printhead level (NL). Alternately, sensors that output a variable signal corresponding to manometer level (ML) may be substituted for high and low level sensors.

To facilitate filling of the fluid reservoir during print head operation (rather than having to change-out an empty fluid reservoir for one that is full), a reservoir supply line (28) and supply valve (30) may be provided. To replenish fluid reservoir (6), an outlet line (32) from a fluid supply vial (34) is connected to valve (30). Fluid may then be pressure-fed or gravity fed into the reservoir (6). The configuration shown in FIG. 2 is suited for pressure feeding. A fluid supply pressure source (36), such as pressurized $N_2$, is provided to controllably introduce gas into vial inlet (38) to displace its fluid contents, sending them to reservoir (6).

Clearly, to facilitate such action, an airtight seal should be made between the inlet, outlet and vial. A stopper like that used for the reservoir may be used for this purpose. Irrespective of such details, once the reservoir (6) is filled, the valve (30) is closed-off so the system behaves as shown in FIG. 1. Still, even during refilling reservoir (6), pressure maintenance with pressure or vacuum from source (20) applied along optional compensation line (40) is possible.

It is contemplated that a pressure gauge other than manometer (8) may be used in connection with the refilling features of the invention just described. For instance, a standard dial gauge may be used in this aspect of the invention. However, a manometer is still preferred in view of the particular advantages it offers.

Sometimes it may be necessary to clear-out lines in the system that carry printing medium. For instance, this may be done in order to flush the system prior to changing the type of printing medium. It may also be necessary at times to purge the printhead (2) to clear a blockage.

To clear printhead (2), valve (16) is closed and pressure is applied by the compensation source (20)—or the supply pressure source (36)—to force fluid out the printhead. When valve (16) is left open and pressure is applied to reservoir (6), the contents of the manometer (8) can be purged from the vent line (42).

It may be desired to use wash fluids (e.g., de-ionized water, etc.) for purging system components. This can easily be accomplished using supply vial (34), substituting the fluid sent into the system. Naturally, purging can be accomplished other ways as well—such as by connecting a water hose directly to line (10) or elsewhere. What is unique in the system with respect to purging is the ability to direct purging flow by way of valve (16).

EXAMPLE

The present invention is used in producing graphics and alphanumeric printed product using ink as a print medium (26). One color (usually black) printing may be accomplished with the system as shown. Multiple color jobs are accomplished by multiplexing a plurality of printheads, each attached to a system like that shown and described or, more preferably, by running plurality of supply systems according to the invention with multiple supply lines (4) feeding a single printhead unit (2).

The invention is used in producing biochips or arrays/microarrays using print mediums comprising biopolymers or biopolymeric ligands (e.g., proteins, DNA, etc.) or precursors thereof, (e.g., activated nucleotide or amino acid residues, etc.) in suspension as a print medium (26). Suitable compositions include those discussed in the references cited above. A system advantageously used in connection with the present invention, especially when producing such arrays, is described in U.S. patent application Ser. No. 10/017,336 titled, "Flow Cell Humidity Sensor System," filed an even date herewith. Further chemical array printing system features advantageously used in connection with the present system are described in the references cited therein, including U.S. patent application Ser. No. 09/150,504 titled, "Method and Apparatus for Making Nucleic Acid Arrays;" U.S. patent application Ser. No. 09/300,589 titled, "Method of Performing Array-Based Hybridization Assays Using Thermal Inkjet Deposition of Sample Fluids;" U.S. patent application Ser. No. 09/846,474 titled "Error Detection In Chemical Array Fabrication", and U.S. Pat. Nos. 6,242,266 and 6,180,351. Other components of array printing systems which may be adapted for use with the present invention include U.S. Pat. Nos. 4,877,745; 5,338,688; 5,474,796; 5,449,754; 5,658,802 and 5,700,637.

Arrays produced with the invention will be used with one or more additional components necessary such as sample preparation reagents, buffers, labels or the like. Some or all of these components may be provided in packaged combination with a set of instructions, possibly associated with a package insert or the package itself. Biochip or array devices may be used in any number of analyte detection assays including differential gene expression assays, gene identification assays, nucleotide sequencing assays, and the like. Further uses of arrays made according to the present invention are also described in the above cited references.

The arrays produced by the subject methods find use in a variety applications, where such applications are generally analyte detection applications in which the presence of a particular analyte in a given sample is detected at least qualitatively, if not quantitatively. Protocols for carrying out such assays are well known to those of skill in the art and need not be described in great detail here. Generally, the sample suspected of comprising the analyte of interest is contacted with an array produced according to the subject methods under conditions sufficient for the analyte to bind to its respective binding pair member that is present on the array. Thus, if the analyte of interest is present in the sample, it binds to the array at the site of its complementary binding member and a complex is formed on the array surface. The presence of this binding complex on the array surface is then detected, e.g. through use of a signal production system, e.g. an isotopic or fluorescent label present on the analyte, etc. The presence of the analyte in the sample is then deduced from the detection of binding complexes on the substrate surface.

Specific analyte detection applications of interest include hybridization assays in which the nucleic acid arrays of the subject invention are employed. In these assays, a sample of target nucleic acids is first prepared, where preparation may include labeling of the target nucleic acids with a label, e.g. a member of signal producing system. Following sample preparation, the sample is contacted with the array under hybridization conditions, whereby complexes are formed between target nucleic acids that are complementary to probe sequences attached to the array surface. The presence of hybridized complexes is then detected. Specific hybridization assays of interest which may be practiced using the subject arrays include: gene discovery assays, differential gene expression analysis assays; nucleic acid sequencing assays, and the like. Patents and patent applications describing methods of using arrays in various applications include: U.S. Pat. Nos. 5,143,854; 5,288,644; 5,324,633; 5,432,049; 5,470,710; 5,492,806; 5,503,980; 5,510,270; 5,525,464, 5,547,839; 5,580,732; 5,661,028; 5,800,992; WO 95/21265; WO 96/31622; WO 97/10365; WO 97/27317; EP 373 203; and EP 785 280; the disclosures of which are herein incorporated by reference.

In gene expression analysis with microarrays, an array of "probe" nucleic acids is contacted with a nucleic acid sample of interest. Contact is carried out under hybridization conditions and unbound nucleic acid is then removed. The resultant pattern of hybridized nucleic acid provides information regarding the genetic profile of the sample tested. Gene expression analysis finds use in a variety of applications, including: the identification of novel expression of genes, the correlation of gene expression to a particular phenotype, screening for disease predisposition, identifying the effect of a particular agent on cellular gene expression, such as in toxicity testing; among other applications.

In certain embodiments, the subject methods include a step of transmitting data from at least one of the detecting and deriving steps, as described above, to a remote location. The data may be raw data (such as fluorescence intensity readings for each feature in one or more color channels) or may be processed data such as obtained by rejecting a reading for a feature which is below a predetermined threshold and/or forming conclusions based on the pattern read from the array (such as whether or not a particular target sequence may have been present in the sample). By "remote location" is meant a location other than the location at which the array is present and hybridization occur. For example, a remote location could be another location (e.g. office, lab, etc.) in the same city, another location in a different city, another location in a different state, another location in a different country, etc. The data may be transmitted or otherwise forwarded to the remote location for further evaluation and/or use. Any convenient telecommunications means may be employed for transmitting the data, e.g., facsimile, modem, internet, etc. When one item is indicated as being "remote" from another, this is referenced that the two items are at least in different buildings, and may be at least one mile, ten miles, or at least one hundred miles apart. "Communicating" information references transmitting data representing that information as signals (such as electrical or optical) over a suitable communication channel (for example, a private or public network). "Forwarding" an item refers to any means of getting that item from one location to the next, whether by physically transporting that item or otherwise (where that is possible) and includes, at least in the case of data, physically transporting a medium carrying the data or communicating the data.

Following receipt by a user of an array made by an apparatus or method of the present invention, as described above, the array will typically be exposed to a sample (for example, a fluorescently labeled polynucleotide or protein containing sample) and the array then read. Reading of the array may be accomplished by illuminating the array and reading the location and intensity of resulting fluorescence at each feature of the array. For example, a scanner may be used for this purpose which is similar to the GENEARRAY scanner manufactured by Agilent Technologies, Palo Alto, Calif. Other suitable apparatus and methods are described in U.S. patent applications: Ser. No. 09/846,125 "Reading Multi-Featured Arrays" by Dorsel et al.; and Ser. No. 09/430,214 "Interrogating Multi-Featured Arrays" by Dorsel et al. However, arrays may be read by any other method or apparatus than the foregoing, with other reading methods including other optical techniques (for example, detecting chemiluminescent or electroluminescent labels) or electrical techniques (where each feature is provided with an electrode to detect hybridization at that feature in a manner disclosed in U.S. Pat. No. 6,251,685, U.S. Pat. No. 6,221,583 and elsewhere). Results from the reading may be raw results (such as fluorescence intensity readings for each feature in one or more color channels) or may be processed results such as obtained by rejecting a reading for a feature which is below a predetermined threshold and/or forming conclusions based on the pattern read from the array (such as whether or not a particular target sequence may have been present in the sample, or whether or not a pattern indicates a particular condition of an organism from which the sample came). The results of the reading (processed or not) may be forwarded (such as by communication) to a remote location if desired, and received there for further use (such as further processing).

Whatever the type of printed product, the invention is used to accurately control the pressure of print medium (26) at the ink-jet or pulse-jet nozzle(s) level (NL). Fluid reservoir (6) is attached to a variable pressure line (40) in communication with the vessel. Positive or negative pressure is applied along the pressure line. A refill line (28) is also in communication with vessel (6). This line is capped by a valve (30). Another line defining manometer (8) includes a "U" shape. The base of the U is placed below the nozzle lever (NL). When pressure in vessel (6) is fully compensated, the manometer lever (ML) is even with nozzle lever (NL). In instances where a slight negative pressure is preferred, manometer level (ML) is slightly below nozzle lever (NL). Sensors (22) and (24) monitor changes in the manometer level. Changes in the level initiate higher or lower pressure application to vessel (6) by compensation source (20).

Depending on the fluid level within the reservoir (RL), positive or negative pressure is applied by the compensation source. When reservoir level (RL) is above nozzle level (NL), negative compensation pressure is applied. When reservoir lever (RL) is below nozzle level (NL), positive compensation pressure is applied. In either instance, or where a switch from positive to negative pressure is in order (or vice versa) the pressure is varied to maintain a desired pressure range at nozzle level (NL) as reservoir level (RL) changes.

In replenishing reservoir (6), supply vessel (34) is connected to valve (30) by supply vessel line (32). Valve (30) is opened and print medium (26) is forced into vessel (6) by pressure applied by fluid supply pressure source (36). Resulting change of the reservoir liquid level (RL) alters the manometer level (ML) and the sensors initiate a change in compensation pressure to restore the desired pressure at the printhead. Bubbles that are trapped in the line between supply vial (34) and reservoir (6) are expelled in the reservoir and are not passed to printhead (2) by virtue of the dual line arrangement within reservoir (6) where supply line (10) remains submerged in fluid as shown.

When flooding the printhead (2) for operation, valve (16) is closed to allow fluid to be purged through the printhead nozzle(s). Valve (16) is also closed and pressure applied by compensation source (20) to force fluid through a nozzle to remove any blockage that might form.

What is claimed is:

1. A printing system comprising:

a pulse-jet printhead including a nozzle, a manometer and lines configured to individually connect said printhead and manometer to a fluid source or to connect said printhead and manometer to a fluid source supply exit line from said fluid source, said fluid source to be connected to a variable pressure compensation source, wherein said system is adapted to vary an output of said variable pressure compensation source to maintain a fluid level within said manometer in a predetermined range to maintain fluid pressure at said nozzle within a corresponding range.

2. The system of claim 1, further comprising said fluid source.

3. The system of claim 2, further comprising a sensor to generate a signal in response to the fluid level within said manometer, and a control unit which generates a control signal for said variable pressure compensation source in response to said sensor signal.

4. The system of claim 1, further comprising a variable pressure compensation source.

5. The system of claim 1, further comprising a first valve at an exit of said manometer.

6. The system of claim 1, further comprising a print medium.

7. A method of detecting, the presence of an analyte in a sample, said method comprising:

contacting (i) a biopolymeric array having a polymeric ligand that specifically binds to said analyte, with (ii) a sample suspected of comprising said analyte under conditions sufficient for binding of said analyte to a biopolymeric ligand on said array to occur; and detecting the presence of binding complexes on the surface of the said array to detect the presence of said analyte in said sample;

wherein said biopolymeric array is produced by a method comprising:

providing a printing system comprising a pulse-jet printhead, a pressure gauge, a reservoir, and a fluid supply vessel, wherein said reservoir has an inlet line and an outlet line, said inlet line capped by a valve for connection to a fluid supply vessel and said outlet line in fluid communication with said printhead, wherein said pressure gauge comprises a manometer, and wherein said fluid supply vessel is connected to said reservoir via a supply vessel line connected to said valve;

connecting said fluid supply vessel to said reservoir;

opening said valve, and feeding print medium from said fluid supply vessel to said reservoir, wherein said print medium is fed under pressure to said reservoir during use of said pulse-jet nozzle, and wherein said print medium comprises a biopolymer or precursor thereof.

8. The method according to claim 7, wherein said method further comprises a data transmission step.

9. A method according to claim 8 wherein the data is communicated to a remote location.

10. A method comprising receiving data representing a result of a reading obtained by the method of claim 7.

11. A printing system comprising:

a pulse-jet printhead including a nozzle, a manometer and lines configured to individually connect said printhead and manometer to a fluid source or to connect said printhead and manometer to a fluid source supply exit line from said fluid source, said fluid source to be connected to a variable pressure compensation source, wherein a first valve is provided at an exit of said manometer and a second valve is provided at an entrance to a fluid reservoir, and wherein said system is adapted to vary an output of said variable pressure compensation source to maintain a fluid level within said manometer in a predetermined range to maintain fluid pressure at said nozzle within a corresponding range.

12. A printing system comprising:

a pulse-jet printhead including a nozzle, a manometer and lines configured to individually connect said printhead and manometer to a fluid source or to connect said printhead and manometer to a fluid source supply exit line from said fluid source, said fluid source to be connected to a variable pressure compensation source, wherein said system is adapted to vary an output of said variable pressure compensation source to maintain a fluid level within said manometer in a predetermined range to maintain fluid pressure at said nozzle within a corresponding range, the system including a print medium comprising a biopolymer or precursor thereof.

13. A printing system comprising:

a pulse-jet printhead including a nozzle, a manometer and lines configured to connect said printhead and manometer at a common point to a fluid source to be connected to a variable pressure compensation source, wherein said system is adapted to vary an output of said variable pressure compensation source to maintain a fluid level within said manometer in a predetermined range to maintain fluid pressure at said nozzle within a corresponding range, the system comprising said fluid source and a supply vessel to feed a print medium to said fluid source, wherein a first valve is provided at an exit of said manometer and a second valve is provided at an entrance to a fluid reservoir, and wherein the system is adapted for said feeding to occur during use of said pulse jet nozzle.

14. A method of maintaining a desired pressure of a print medium at a pulse-jet nozzle comprising:

providing a system comprising a manometer and lines configured to connect said nozzle and manometer at a common point to a fluid reservoir;

applying pressure to said fluid reservoir;

monitoring a fluid level in said manometer;

adjusting said pressure applied to said fluid reservoir in response to changes in said manometer level, attaching a fluid supply vessel to said fluid reservoir upon closing a first valve provided at an exit of said manometer and opening a second valve provided at an entrance to a fluid reservoir; and feeding a print medium from said fluid supply vessel to said fluid reservoir.

* * * * *